United States Patent [19]

Clary

[11] Patent Number: 4,765,351

[45] Date of Patent: Aug. 23, 1988

[54] DUAL TEMPERATURE WATER HEATER

[76] Inventor: Kenneth B. Clary, 5635 Whitner Dr., NW., Atlanta, Ga. 30327

[21] Appl. No.: 768,663

[22] Filed: Aug. 23, 1985

[51] Int. Cl.[4] ..... B08B 3/10

[52] U.S. Cl. ..... 134/56 D; 134/57 D; 134/107; 219/323

[58] Field of Search ..... 134/56 D, 57 D, 58 D, 134/107, 105; 219/323, 328; 68/207

[56] References Cited

U.S. PATENT DOCUMENTS

| | | | |
|---|---|---|---|
| 2,254,269 | 9/1941 | Clark et al. | 134/107 X |
| 2,480,302 | 8/1949 | Pankow . | |
| 2,621,666 | 12/1952 | Ornas | 134/57 D |
| 2,781,765 | 2/1957 | Steidley | 134/57 D |
| 2,852,018 | 9/1958 | Williams . | |
| 2,948,277 | 8/1960 | Dennis . | |
| 3,007,470 | 11/1961 | Heeger . | |
| 3,351,130 | 11/1967 | Lowe . | |
| 3,917,165 | 11/1975 | Cross . | |
| 4,413,775 | 11/1983 | Scott . | |
| 4,467,178 | 8/1984 | Swindle . | |

OTHER PUBLICATIONS

Water Heating for Commercial Kitchens, Dunn, Thomas Z. et al., May 1959.

Dishwasher Package, Ace Buehler Inc., May 1975.

Ace Heater Hook-Up Horizontal/Vertical, Ace Buehler Inc., Mar. 1978.

Package-Hot Water Systems, Ace Buehler Inc., Oct. 1980.

Physical Characteristics, Atmospheric Gas Water Heaters, Series 125-G, Jul. 1981.

Heaters, Ace Buehler Inc., Oct. 1980.

Heaters & Boilers, Ace Buehler Inc., Mar. 1982.

Installation & Maintenance-Manual for Commercial Atmosphere Gas Water Heaters, PVI Industries, Inc., May 1982.

Copperglas Water Heaters, Energy Source: Atmospheric Gas, PVI Industries, Inc., Mar. 1983, Feb. 1984.

*Primary Examiner*—Harvey C. Hornsby

*Assistant Examiner*—Frankie L. Stinson

*Attorney, Agent, or Firm*—Saidman, Sterne, Kessler & Goldstein

[57] ABSTRACT

An improved dishwasher and hot water heater system is disclosed in which the dishwasher comprises means for automatically causing the water temperature in the hot water heater storage tank to be raised to a temperature suitable for sterilization of dishes by rinsing upon actuation of the dishwasher. No operator input is required, yet water is not maintained at the rinse temperature when the dishwasher is not being used.

5 Claims, 3 Drawing Sheets

12
MANUAL SWITCH
18
10
16
14
(A)
WATER HEATER
DISHWASHER
12
FLOW SWITCH
22
18
RINSE CYCLE LINE
(B)

10
HALF-HOUR DELAY TIMER
24
14
WATER HEATER
DISHWASHER
12
(C)
10
18
14
120° F THERMOSTAT
WATER HEATER
26
DISHWASHER

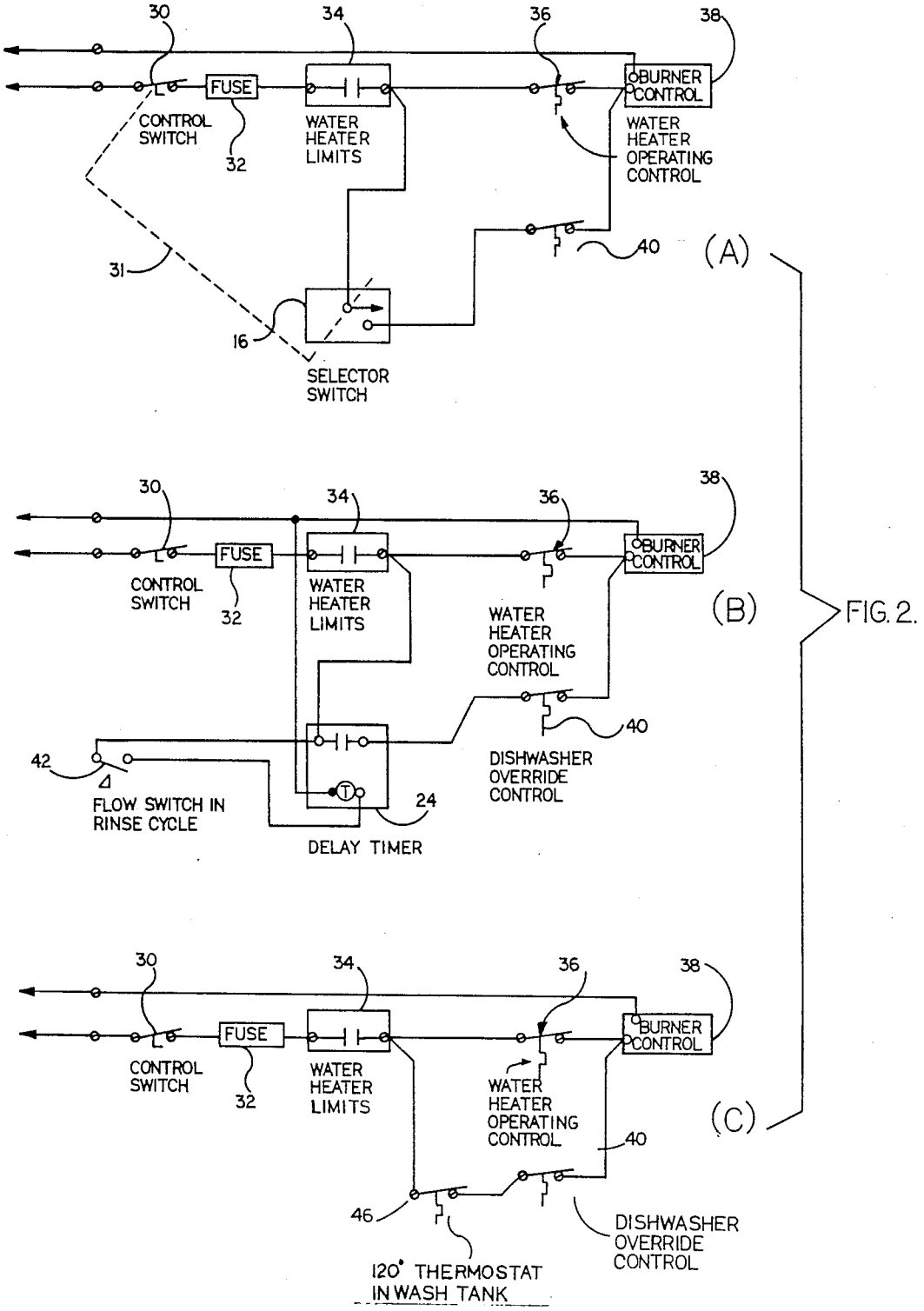
30
34
36
38
FUSE
BURNER CONTROL
CONTROL SWITCH
32
WATER HEATER LIMITS
WATER HEATER OPERATING CONTROL
40
(A)
31
16
SELECTOR SWITCH
30
34
36
38
FUSE
BURNER CONTROL
CONTROL SWITCH
32
WATER HEATER LIMITS
WATER HEATER OPERATING CONTROL
(B)
FIG. 2.
40
42
FLOW SWITCH IN RINSE CYCLE
24
DELAY TIMER
DISHWASHER OVERRIDE CONTROL
30
34
36
38
FUSE
BURNER CONTROL
CONTROL SWITCH
32
WATER HEATER LIMITS
WATER HEATER OPERATING CONTROL
(C)
40
46
120° THERMOSTAT IN WASH TANK
DISHWASHER OVERRIDE CONTROL

DUAL TEMPERATURE WATER HEATER

FIELD OF THE INVENTION

This invention relates to the field of water heaters. More particularly, this invention relates to the field of water heaters which are provided with dual thermostats for heating water to two different temperatures, a higher temperature for use in rinsing of dishes in dishwashers and a lower temperature for other uses.

BACKGROUND AND OBJECTS OF THE INVENTION

Typical health regulations require that dishwashers in public establishments be supplied with rinse water of at least 180° F. for purposes of sterilization. Water at this temperature is too hot for other hot water uses, such as the washing of hands, and is unnecessarily hot for other purposes such as the washing of clothing. In such establishments, water at two temperatures must be available.

The prior art has provided several ways in which this can be done. One common scheme is to provide a hot water heater which heats and stores hot water at 180° F. and a mixing valve for mixing this water with cold water as needed to satisfy a demand for water of a lower temperature. This is inefficient, because the heat lost in storage of water at higher temperatures is greater over time than from water stored at lower temperatures. In particular, because dishwasher usage is typically intermittent, storage of a large quantity of water at 180° F. is wasteful of energy. Those skilled in the art will also be aware that unnecessarily high water temperatures are harder on equipment, and require more maintenance thereof, as the amount of mineral precipitates increases exponentially with temperature.

Heeger U.S. Pat. No. 3,007,470 shows another system in which the improvement is that separate 180° F. and lower temperature (typically 140° F.) water storage tanks are provided. This is unduly complex. Other references show systems in which two thermostats are provided. The selection of one is made by an operator when it is anticipated that water at a higher temperature will be required for rinsing dishes after being washed. See, e.g., Swindle U.S. Pat. No. 4,467,178 and Pankow U.S. Pat. No. 2,480,302. See also Lowe U.S. Pat. No. 3,351,130.

All of the latter systems referred to above have the common defect of requiring operator intervention. This raises the possibility of error on the part of the operator. This is a serious matter, especially as the public health is at issue in connection with the sanitation of dishes. Therefore, it would be desirable to provide an automatic system for ensuring that water of adequate heat to ensure sterility of the dishes is always provided whenever a commercial dishwasher is operated, so as to provide foolproof sterilization.

To provide such a system is therefore an object of the invention.

A further object of the invention is to provide a hot water heating system in which hot water is stored at a temperature less than the temperature required for sterilization, e.g. at 140° F., when sterilization of dishes is not required, but in which the water is automatically heated to a temperature high enough to achieve sterilization whenever the dishwasher is run. In this way a foolproof, highly reliable dishwashing system in which sterilization is automatic is provided.

SUMMARY OF THE INVENTION

The present invention meets the needs of the art and objects of the invention discussed above by its provision of an improved hot water supply and dishwasher system. A switch in the dishwasher which selects one of two thermostats in the hot water heater is actuated whenever the dishwasher is turned on, so as to cause the temperature of water in the hot water storage reservoir connected to the hot water heater to be increased to a temperature adequate to sterilize dishes after washing.

In the preferred embodiment, the water heater is provided with two thermostats, one set at the ordinary hot water temperature and one at the higher temperature required for sterilization of dishes. A switch is provided to connect one or the other of the thermostats in circuit, depending on activation of the dishwasher. The switch may be part of the switch which turns the dishwasher unit on, such that it must always be thrown when the dishwasher is used. Alternatively, it can be a switch operated by a sensor which detects a condition which occurs whenever the dishwasher is operated, e.g., water flow in the dishwasher rinse line or the presence of water in the wash tank of the dishwasher.

BRIEF DESCRIPTION OF THE DRAWINGS

The invention will be better understood if reference is made to the accompanying drawings, in which:

FIG. 2 shows wiring diagrams corresponding to the three different embodiments of the system according to the invention shown in FIG. 1.

DESCRIPTION OF THE PREFERRED EMBODIMENTS

As discussed above, it is the object of the invention to provide the dishwashing system in which it is impossible to operate a dishwasher without setting the thermostat on an associated hot water heater to a temperature which will provide water hot enough for sterilization of dishes. According to the preferred embodiment of the invention, this object is achieved by provision of a dual-thermostat water heater in combination with a dishwasher having a switch for selection of one of the two thermostats, the switch being such that its actuation is automatic upon actuation of the dishwasher.

Figure 1:
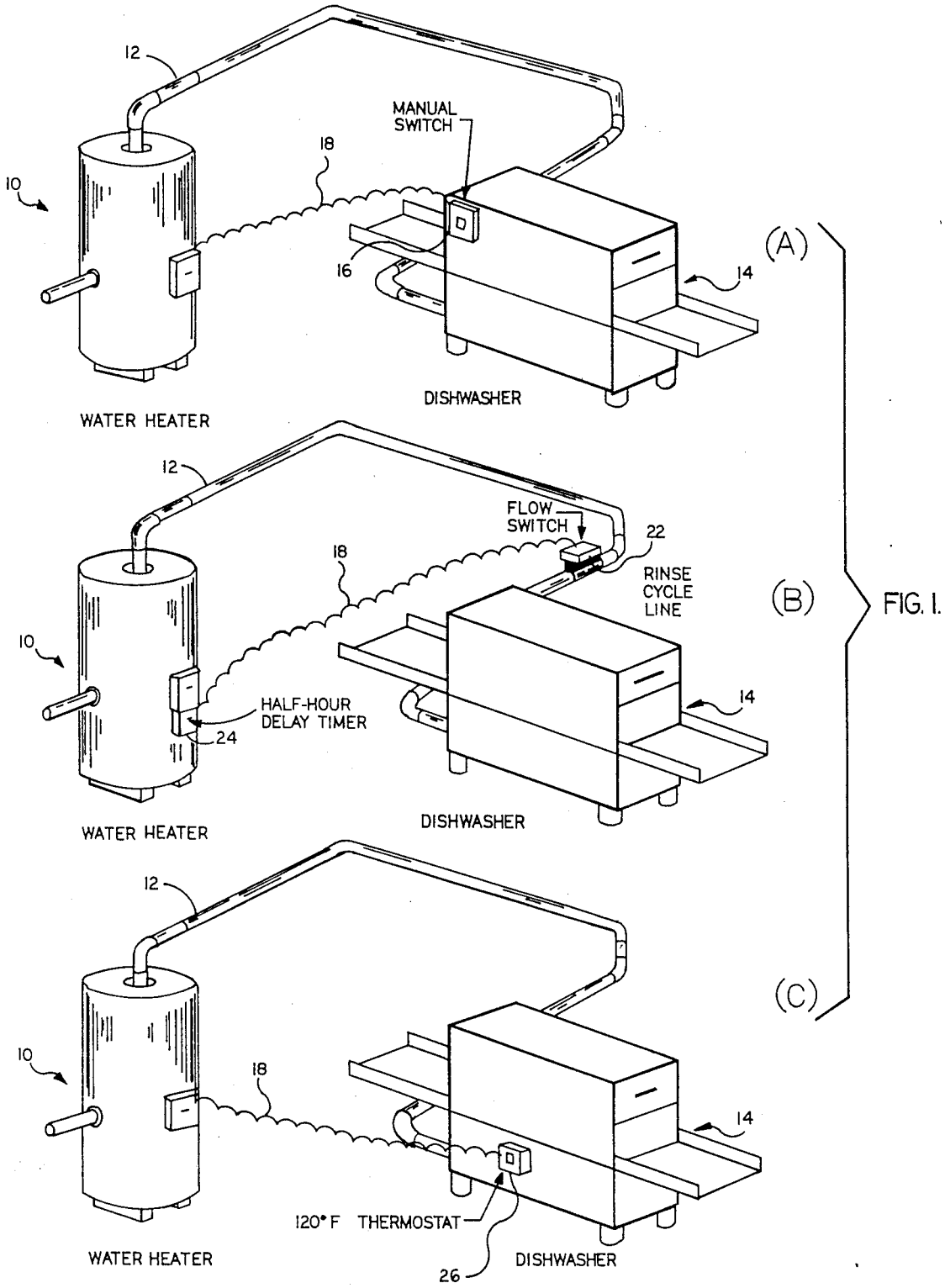
FIG. 1 shows three different embodiments of a water heating system according to the invention.

FIG. 1A shows one way in which this objective can be achieved. As shown in FIG. 1A, a water heater 10 is connected by a pipe 12 to a dishwasher 14. On the dishwasher 14 is mounted a switch 16 which is the main power switch for the dishwasher. Connected to this switch 16 is a connecting wire or cable 18 which when actuated selects a higher temperature thermostat of two thermostats on the water heater 10. (The thermostats are not shown in FIG. 1, but are discussed in detail in connection with FIGS. 2 and 3.) In this way, the water is heated to a higher temperature than otherwise.

It will be appreciated by those skilled in the art that this additional heating will necessarily take some minimum amount of time. In most commercial dishwashing installations, however, the operator is required to run the dishwasher for some minutes prior to actually washing dishes, to ensure that the inside of the dishwasher is fully rinsed, that all its other operating systems are functioning correctly, that the wash water (which is usually reused) is up to temperature and so forth. Accordingly, when the dishwasher is first turned on, there is an unavoidable time lag in any event before any dishes are to be washed or need to be rinsed; during this period, the water in the water heater 10 can be heated to the temperature required for sterilization. As mentioned, most health authorities require at least 180° F. rinse water in commercial dishwasher installations; heating the water from e.g. 140° F. to 180° F. takes on the order of five minutes in typical systems.

FIG. 1B shows a second embodiment of the invention in which a flow detecting switch 22 which controls the selection between the thermostats by way of cable 18 is connected to detect flow in the rinse cycle line. When water is detected in the rinse cycle line, the flow switch automatically causes the higher temperature thermostat to be selected. In this way, when the dishwasher is first turned on and water is pumped through the rinse cycle line as part of the warm-up process, the water heater is automatically caused to heat the water to a temperature suitable for rinsing.

In a particularly preferred embodiment, a delay timer 24 is actuated upon actuation of the flow switch 22. In this way the temperature of the water is maintained at the elevated temperature for a specified minimum length of time, so that if the dishwasher should be temporarily turned off, so that no water is present in the rinse cycle line, the hot water heater will nevertheless maintain the temperature of the water at a suitable rinse temperature for a specified period of time, e.g., one-half hour. This will enable speedy restarts for the dishwasher.

FIG. 1C shows a third embodiment of the invention in which the selection of thermostats is made by a third thermostat 26 which is located in the wash tank of the dishwasher. This thermostat is set to trip at the usual temperature of the wash water so that when the wash water in the dishwasher is at working temperature, meaning that the dishwasher is operational, the thermostat 26 will cause the higher-temperature thermostat on the water heater 10 to be selected.

FIGS. 2A–2C show typical wiring schematics for the three embodiments of the system of the invention shown in FIGS. 1A–1C, respectively. In FIG. 2A, a selector switch 16 and a second thermostate 40 are added to the ordinary water heater control circuit, which comprises an on/off control switch 30, a fuse 32, a limit switch 34 (a safety device which trips when the water temperature reaches an unsafe temperature, typically 200° F.) and a thermostat 36 which may be set to provide water at temperature, suitable for washing of one's hands and the like, typically 120°–140° F. The control voltage V is then fed to the heater control 38. According to the invention, there is added a selector switch 16 which, in the preferred embodiment, is part of the same switch gear as the main on/off switch 30 of the dishwasher. This is indicated by the dashed line 31 indicating that switches 30 and 16 are ganged. In this way, when the main power switch of the dishwasher is turned on, the selector switch 16 is turned on as well. This connection adds into the circuit the second thermostat 40 which is set for the rinse water temperature, typically 180° F.

As will be understood by those of skill in the art, both the thermostats 36 and 40 are in the circuit at once; however, of course, the higher temperature thermostat 40 will control so that water will continue to be heated until thermostat 40 opens, thus cutting the current to the heater control 38.

The circuit of FIG. 2B, corresponding to the embodiment of FIG. 1B, is generally similar to that shown in FIG. 2A, and common components are shown with common reference numerals. In this case, however, the second thermostat 40, provided according to the invention to control heating of the higher temperature rinse water, is put into the circuit by a flow switch 42. The flow switch 42 is in the rinse cycle line, such that it opens when water is in the rinse line. In a preferred embodiment, a delay timer 24 is also provided in the circuit as shown. When water in the rinse cycle line has been detected by the flow switch 42, the delay timer 24 is actuated. The timer 24 ensures that the higher temperature thermostat 40 will stay in the circuit for some minimum period of time. Thus, even if the dishwasher is shut down, so that there is no water in the rinse cycle line, the water will remain at the higher rinse water temperature for some time in case the dishwasher should thereafter be reactivated.

FIG. 2C, corresponding to the embodiment of FIG. 1C, shows a circuit in which the higher-temperature thermostat 40 is controlled by a third thermostat 46 which is in the wash tank. Typically, the wash water is reused, and must be heated to a minimum working temperature before the dishwashing may be operated. In this way, whenever water of a certain minimum temperature is in the wash tank, meaning that the dishwasher is operational, the higher-temperature thermostat 40 will be in circuit and will ensure that the water is at a high enough temperature for sterile rinsing.

Figure 3:
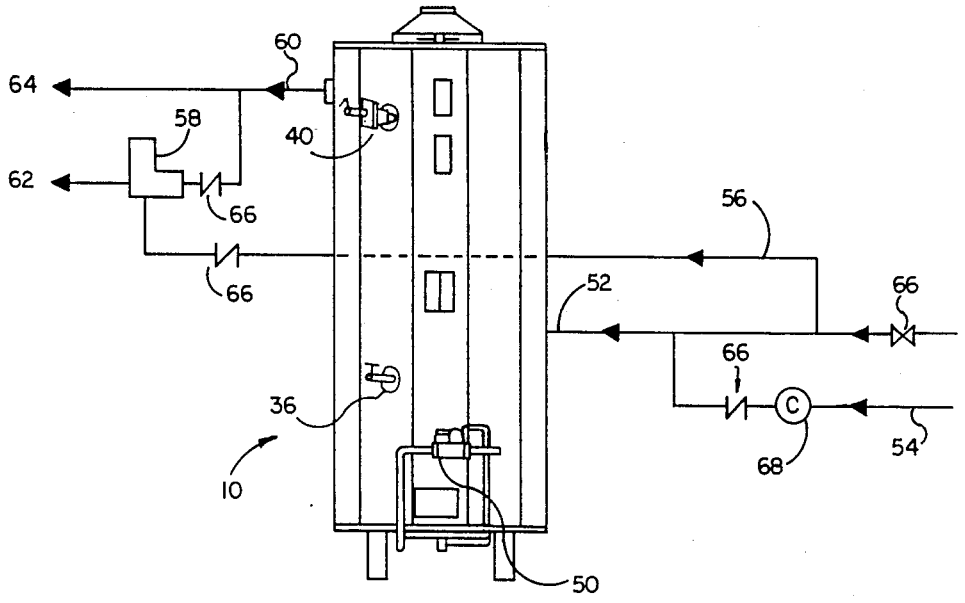
FIG. 3 shows a more detailed view of the water heater according to the invention.

FIG. 3 shows the hot water heater 10 according to the invention. As is conventional, it comprises a heat source 50 which may be a gas or oil burner or an electric heater, which is in thermal communication with a reservoir of water. Cold water is supplied by way of a first pipe 52 to the reservoir. This may include cool or warm water returned by way of a second pipe 54 from an auxiliary rinse water storage tank (not shown), to ensure that the stored water is kept up to proper rinse temperature. The cold water is also bypassed by way of a third line 56 to a mixing valve 58 where it is mixed with the hot water which exits from the reservoir by way of a fourth line 60. Water at for example 120° for hand washing and the like is provided at an outlet 62 of valve 58, whereas the hot rinse water is provided at 64. Two thermostats 36 and 40 are provided, as discussed above in connection with FIGS. 2A–2C. Shut-off valves 66 can be provided in the various lines as necessary. A circulation pump 68 may be provided to ensure that any rinse water stored in an auxiliary tank is recirculated properly so that the rinse water is always up to temperature.

It will be appreciated that there has been described an improved water heater and dishwasher apparatus in which operation of the dishwasher automatically will ensure that the temperature of the rinse water is high enough to ensure sterilization of dishes being washed. At the same time, when the dishwasher is not in use, the hot water is not required to be maintained at this high temperature. This arrangement is subsantially more energy efficient than a system in which water is maintained at the higher rinsing temperature at all times. This is particularly noticeable in establishments such as churches and schools, where rinse water is only required once per day or week. If it were required to maintain water at rinsing temperature for the remainder of the time, a substantial energy loss would be inevitable. Equipment life is also shortened by unnecessarily high water temperatures, and additional maintenance is required due to mineral buildup.

Those skilled in the art will recognize that while there has been described a preferred embodiment of the invention, there are many other variations and improvements which can be made to the invention without materially affecting its scope. In particular, the problem of requiring hot water at plural temperatures is faced other than in connection with dishwashers, in particular, in commercial laundries. The claims hereof should therefore be interpreted to include other sorts of washing equipment within the term "dishwasher". Accordingly, the invention is to be measured not by the above exemplary disclosure, but only by the following claims.

I claim:

1. A water heater for automatically controlling the temperature of water, comprising:

a. means for storing water having a means for heating water affixed thereto;

b. said means for heating water being adapted to heat water in said storage means to a predetermined first temperature, said predetermined first temperature being greater than ambient temperature;

c. thermostat means for controlling said means for heating water and for maintaining the water in said storing means at said predetermined first temperature in response to a first predetermined setting of said thermostat means; and d. means for changing the setting of said thermostat to a second predetermined setting which is higher than said first predetermined setting so as to heat the water in said storing means to a predetermined second temperature higher than said predetermined first temperature, said means for changing the setting of said thermostat being responsive to a predetermined external condition.

2. The apparatus of claim 1 wherein said means for changing the setting of said thermostat comprises a first switch linked to a control switch controlling operation of a washer, such that when said control switch is activated for activation of the washer, the first switch is necessarily also activated.

3. The apparatus of claim 1 wherein said means for changing the setting of said thermostat comprises means for detecting flow of water in a rinse line connected to a dishwasher.

4. The water heater of claim 1 wherein said means for changing the setting of said thermostat comprises a further thermostat disposed within a dishwasher at a position such that if said dishwasher is operated, water is exposed to said further thermostat.

5. The water heater of claim 1 wherein said means for changing the setting of said thermostat comprises plural thermostat assemblies.

* * * * *